United States Patent [19]

Luthra

[11] Patent Number: 4,617,492

[45] Date of Patent: Oct. 14, 1986

[54] HIGH PRESSURE SODIUM LAMP HAVING IMPROVED PRESSURE STABILITY

[75] Inventor: Krishan L. Luthra, Schenectady, N.Y.

[73] Assignee: General Electric Company, Schenectady, N.Y.

[21] Appl. No.: 698,512

[22] Filed: Feb. 4, 1985

[51] Int. Cl.[4] ..... H01J 17/04; H01B 1/06

[52] U.S. Cl. ..... 313/630; 252/521; 313/633; 313/346 R

[58] Field of Search ..... 252/521, 181.6; 313/630, 633, 346 R, 346 DC, 571, 572

[56] References Cited

U.S. PATENT DOCUMENTS

| | | | |
|---|---|---|---|
| 3,453,477 | 7/1969 | Hanneman et al. | 313/571 |
| 3,708,710 | 1/1973 | Snyser et al. | 313/630 |
| 4,052,641 | 10/1977 | Dominick et al. | 252/521 |
| 4,155,758 | 5/1979 | Evans et al. | 252/521 |
| 4,251,569 | 2/1981 | Mager et al. | 313/346 R |
| 4,313,854 | 2/1982 | Sunahara et al. | 313/346 DC |
| 4,319,158 | 3/1982 | Watambe et al. | 252/521 |
| 4,468,586 | 8/1984 | Hohn | 252/521 |

*Primary Examiner*—Josephine L. Barr

*Attorney, Agent, or Firm*—Paul E. Rochford; James C. Davis, Jr.; Paul R. Webb, II

[57] ABSTRACT

High pressure sodium lamps have been subject to progressive reduction in pressure of contained sodium with attendant reduction in lighting quality. It has been discovered that modification of lamp components permits the pressure of contained sodium to be maintained at higher levels. Emission materials enclosed within the lamp are altered to limit reactive oxygen in the lamp atmosphere. A thermionic electrode as equipped with an improved emission composition as illustrated in areas B and C of the triaxial plot of FIG. 3.

6 Claims, 3 Drawing Figures

HIGH PRESSURE SODIUM LAMP HAVING IMPROVED PRESSURE STABILITY

BACKGROUND OF THE INVENTION

The present invention relates generally to deluxe high pressure sodium lamps having jackets of sintered polycrystalline aluminum oxide. More particularly, it relates to modification of lamp structure and components to overcome a problem of loss of pressure within the lamp envelope, and particularly the loss of sodium, and the reduction of the high pressure of sodium vapor necessary to the favorable operation of the lamp.

As used herein the term deluxe, as it is used in reference to high pressure sodium or HPS lamps, means a lamp having a pressure of sodium substantially higher than that of standard or conventional HPS lamps. For convenience of reference DHPS is employed as an alternative designation to the phrase deluxe high pressure sodium as used in connection with lamp structures. The term also designates a lamp which emits a light which is substantially white as contrasted with the light emitted from standard HPS lamps. The light emitted from standard HPS lamps is characteristically golden in coloration.

Components for lamps for the generation of light, which may involve the use of sodium and particularly sodium in high pressure, are disclosed in U.S. Pat. Nos. 4,285,732; 3,026,177; 3,026,210; 3,935,495; 4,079,167; 4,150,317 and 3,788,710. The test of these patents, which are assigned to a common assignee herewith, are incorporated herein by reference.

As is explained in the above patents, sintered polycrystalline aluminum oxide is used as the jacket materials for discharge tubes of lamps. Such lamps may contain high pressure sodium (HPS) of the higher pressure sodium of deluxe (or DHPS lamps) in the discharge tubes. It is possible to obtain the desired partial pressure of sodium in these tubes by using an amalgam of sodium in mercury.

One of the major factors limiting the life of lamps employing the high pressure sodium discharges is the loss of sodium from the discharge. When the partial pressure of sodium within the discharge tube of the lamp is reduced, the light output of the lamp is affected. When the loss of sodium from the vapor phase in the lamp is large, the lamp may not even light when electric voltage is applied to the lamp in the conventional manner to induce operation.

Further it has been observed that a lamp, which initially has a suitably high pressure of sodium for deluxe HPS use, may gradually lose its pressure over a period of lamp use. Thus, although the lamp operates well initially, the useful life of the lamp may be so limited as to make sale and use of the lamp in commerce uneconomical or impractical. The standard HPS lamps have an unpleasant golden color. To be a color improved HPS lamp, so called deluxe lamp (DHPS lamp), the lamp should operate with high pressure of sodium and this pressure is two or three times the pressure of sodium in a standard or conventional HPS lamp. One advantage of such deluxe lamps is that they emit a light which is whiter than that emitted from the lower pressure standard HPS lamps. Standard HPS lamps have lives of the order of 20,000 hours. It has been observed that within 3,000 to 10,000 hours of operation of deluxe HPS lamps, (DHPS lamps) they may lose their color advantage and revert to the standard HPS lamps which emit the unpleasant golden color.

A number of studies have been made and are reported in the literature which have been concerned with the mechanisms by which sodium is lost from high pressure sodium lamps. The following are a number of reports which have been made on this general subject:

(A) Inouye, T, Higashi, T. Ishigani, S. Nagamo, and H. Shimojima, Journal of Light and Vis. Env. 3 (1979) 1.

(B) P. R. Prud'homme Van Reine, "Science of Ceramics", Proceedings of the Twelfth International Conference, June 27–30, 1983, Saint-Vincent Italy, P. Vincenzini (Ed.), Ceramurgica, Italy, 1984, p. 741.

(C) E. F. Wyner, Journal of IES, 8 (1979) 1966.

(D) H. Akutsu, Ph.D. dissertation, "Development of High Pressure Sodium Lamps", Matsushita Electronics Corp., Osaka, Japan 1982.

(E) F. C. Lin and W. J. Knochel, Journal of IES, 3 (1974) 303.

(F) P. Hing, J. Illum. Eng. Soc. 10 (1981) 194.

In the first article, identified as A above, the suggested mechanism for the reduction in the pressure of sodium vapor is one by which leakage occurs through the seal glass. According to references C and E involved, the suggested mechanism for the loss of the sodium of the high pressure sodium vapor is by electrolysis through the tube wall.

The mechanism suggested in the references of D and F is one according to which a reaction occurs with the tube wall and diffusion occurs through the wall. Many investigators believe that the sodium loss occurs by this latter mechanism.

These latter references also suggest that sodium present in the arc tubes reacts with the alumina of the enclosing tube to form beta alumina having formula $Na_2$ 0.11 $Al_2O_3$ and/or sodium aluminate having the formula $NaAlO_2$.

BRIEF SUMMARY OF THE INVENTION

It is accordingly one object of the present invention to provide a high pressure sodium lamp article which is not as subject to loss of the high pressure of sodium vapor as prior art lamps.

Another object is to provide a means by which the high pressure of sodium vapor in an HPS lamp may be retained for an extended period.

Another object is to provide a method of improving the retention of sodium vapor in lamps at high pressure.

Another object is to provide means by which the retention of sodium vapor of deluxe higher pressure sodium lamps may be improved so that they emit a whiter light for a longer time.

Another object is to enhance the operation of high pressure sodium lamps by reducing the tendency of HPS lamps, both deluxe and standard, to loss of pressure of sodium vapor.

Other objects will be in part apparent and in part pointed out in the description which follows.

In one of its broader aspects objects of the invention can be achieved by providing a high pressure sodium vapor lamp having an emission material of a composition selected from the areas designated B and C of the accompanying graph of FIG. 3.

BRIEF DESCRIPTION OF THE DRAWINGS

The description of the invention which follows will be aided by reference to the accompanying drawings in which.

DESCRIPTION OF THE PREFERRED EMBODIMENTS

Figure 1:
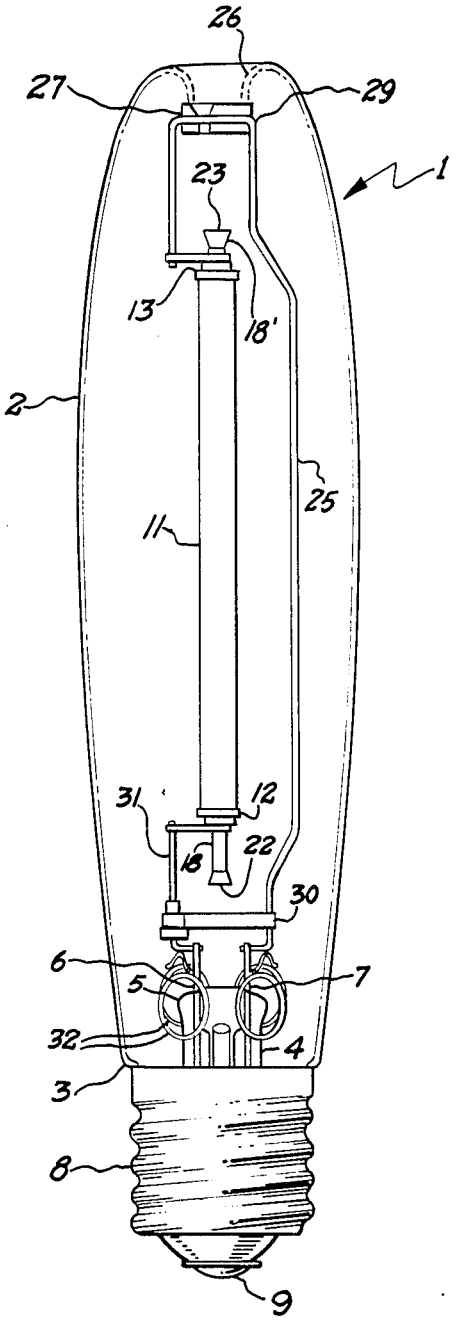
FIG. 1 is a schematic view of a jacketed high pressure sodium vapor lamp embodying the improved emission material of the present invention.

A high intensity sodium vapor discharge lamp in which the invention of the subject application may be embodied, is illustrated at 1 in FIG. 1 and comprises an outer vitreous envelope or jacket 2 of elongated ovoid shape. The neck 3 of the jacket is closed by a reentrance stem 4 having a press seal 5 through which extends stiff in-lead wires 6 and 7 which are connected at their outer ends to the threaded shell 8 and center contact 9 of a conventional screw base. The inner envelope or arc tube 11 is made with sintered high density polycrystalline alumina material to provide increased in-line optical transmission. The ends of the tube are closed by thimble-like niobium metal end caps 12 and 13 which have been hermetically sealed to the improved alumina arc tube by means of a glass sealing composition which is shown, although exaggerated in thickness, at 14 in FIG. 2.

Figure 2:
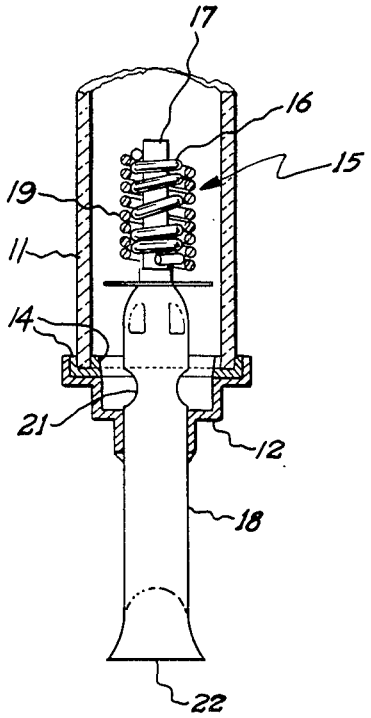
FIG. 2 is a sectional view of an electrode configuration for the lamp depicted in FIG. 1.

Thermionic electrodes 15 are mounted on the ends of the arc tube. As best seen in FIG. 2, the electrode comprises an inner tungsten wire coil 16 which is wound over tungten shank 17 crimped or welded in the end of a niobium tube 18 which is in turn welded to the end cap 12. The central turns of the inner coil 16 are spread apart and the outer tungsten wire coil 19 is screwed over the inner coil.

Heretofore a suitable electron emissive mix, such as that described in U.S. Pat. No. 3,708,710, has been applied to the electrode coils by painting or alternatively by dipping the coils in the emissive mix suspension. The material is retained primarily in the interstices between the turns of outer and inner coil and of inner coil and shank.

The present invention provides an improved composition for use in connection with the emitter function of high pressure sodium vapor lamps.

Continuing now with the description of a typical high pressure sodium vapor lamp, a lower tube 18 is pierced through at 21 and is used as an exhaust tube during manufacture of said lamp. After the gas filling sodium. mercury amalgam has been introduced into the arc tube, exhaust tube 18 is hermetically pinched off a cold weld indicated at 22 and serves thereafter as a reservoir for condensed sodium mercury amalgam. Upper tube 18 has no opening in the arc tube and is used to contain a small amount of yttrium metal (not shown) which serves as a getter; the end of the tube is closed by a pinch 23 which forms a hermetic seal. The illustrated lamp is limited to a base-down operation wherein the longer exhaust tube 18, which must be the coolest portion of the arc tube for the analgam to condense therein, is located lowermost.

The arc tube is supported within the outer envelope by means of a mount comprising a single rod 25 which extends the length of the envelope from in-lead 7 at the stem end to a dimple 26 at the dome end to which it is anchored by a resilient clamp 27. End cap 13 of the improved arc tube is connected to the frame by band 29 while end cap 12 is connected to in-lead 6 through band 30 and support rod.

The inter-envelope space is desirably evacuated in order to conserve heat. The evacuation is done prior to sealing off the outer jacket. A getter, suitably bariumaluminum alloy powder pressed into channeled rings 32 is flashed after sealing in order a high vacuum. A method of manufacturing this type construction is further disclosed in U.S. Pat. No. 3,708,710, which is also incorporated by reference and hence need not be repeated in connection with the present invention.

U.S. Pat. No. 3,708,710 teaches the combination of a high pressure, HPS, sodium vapor lamp in which an electron emission material is incorporated. The composition of the material corresponds to that of the area designated A on the accompanying triaxial plot included in the drawings as FIG. 3.

In U.S. Pat. No. 3,708,710, it is pointed out that the electrodes of the lamp are required to provide copious electron emission and to be resistant to vaporization and ion bombardment, but that these properties do not in general go together.

The object of that patent was to provide a cathode with electron emissive material which is a good emitter and at the same time more resistant to varportion and ion bombardment when used in a deluxe high pressure sodium vapor lamp (DHPS) than materials available heretofore. In this the patentees succeeded.

They did so by the discovery that "digbarium calcium tungstate, $Ba_2CaWO_6$ is a better electon-emitting material for use in high intensity discharge lamps and particularly high pressure sodium vapor lamps than any material up to now", see column 1, line 56.

The dibarium calcium tungstate employed in U.S. Pat. No. 3,708,710 is single phase and is prepared by a variety of well-known techniques as is pointed out in the patent. One technique involves ball milling of the starting constituents, namely $BaCO_3$ and $WO_{2.97}$ and then firing in air at 1700° C. for four hours and then cooling to room temperature. X-ray powder diffraction showed the reaction to the $Ba_2Ca\ WO_6$ to be complete and that only the compound $Ba_2CaWO_6$ to be observed.

Formation of the same composition in situ in the lamp is also disclosed.

U.S. Pat. No. 3,708,710 also discloses that "the $Ba_2CaWO_6$ phase is that desired but emission material which consists of a $Ba_2CaWO_6$ solid solution phase or a solid solution phase together with small amounts of binary phases are also satisfactory", see column 3, line 15.

It is also pointed out in U.S. Pat. No. 3,708,710. that compositions having a mole fraction of CaO greater than 0.30 are not desirable due to insufficient electron emission; that compositions richer in BaO than claimed have an evaporation rate many times higher than $Ba_2CaWO_6$; and that any initial advantage of these BaO containing compositions containing a high percent of BaO, due to higher electron emission, is rapidly dissipated. It is rapidly dissipated because of the higher evaporation rate of a physical mixture having constituents outside the range of solid solubility.

What was not recognized at the time of the invention of U.S. Pat. No. 3,708,710, and what has not been evidently recognized to this date, is that an oxide emission mix can cause sodium loss by chemical reactions. In particular the mix provides chemically bound oxygen which takes part in a reaction yielding solid tungsten metal and gaseous oxygen as follows:

$$WO_3(s)=W(s)+30(g) \quad (1)$$

Here, the underline indicates that $WO_3$ is not present as a single oxide but exists at least than unit chemical activity in combination with other oxygen gas has released by this reaction (1). The oxygen in turn reacts with sodium vapor. The oxygen gas and sodium vapor also react react with $Al_20_3$ from arc tube 11 or seal glass of tube 11 to tie up sodium as sodium B-alumina or sodium aluminate by one or both of the following reactions:

$$2Na(g)+0(g)+11A_2O_3(s)=Na_2O\ 11Al_2O_3(s) \quad (2)$$

$$2Na(g)+0(g)+Al_2O_3(s)=2NaAlO_2(s) \quad (3)$$

The oxygen also forms sodium tungstate with the mix.

According to the invention sodium loss is reduced by reducing to the present invention sodium loss is reduced by reducing the oxygen pressure within the arc tube 11. One way in which I accomplish this is by adding a small quantity of tungsten powder to the emission mix to the extent of a maximum of 25 percent by weight. The percent added depends on the particular size of the oxides of the mix as well as that of the added metal powders. As little as one percent may be added if all powder constituents are of very fine particle size. The highest percentage of metal powder is employed when the oxide powder has finer particle size and the metal powder has larger particle size. The controlling relationships are the surface area to volume ratios of the oxides and metal powders. From reaction (1), based on known thermodynamic principles, the oxygen pressure is lowest if the chemical activity of tungsten is the maximum possible (equal to unity) to unity) and that of $WO_3$ is the minimum possible. In accordance with this invention the purpose of adding power to the mix is to provide a unit activity of tungsten throughout the emission mix.

In accordance with lamp operation pursuant to this invention, there is some loss of BaO and CaO by volatilization. However this same loss occurs for all emission materials containing oxides. I have recognized that the composition of emission material changes in the direction indicated by arrow 10 of FIG. 3. The arror points in the direction in the direction in which the composition of the triaxial plot will move due to increased $WO_3$ chemical activity. If, for example, one starts with phase $Ba_2\ CaWO_6$, the composition changes in the direction indicated by the arrow to make a three phase mixture of $Ba_2CaWO_6$, $BaWO_4$, and $Ca_3WO_6$.

Another object of the invention is to reduce sodium loss by ensuring that the chemical activity of $WO_3$ is the lowest possible and stapys constant throughout the operation of the lamp. This object can be side accomplished pursuant of this invention by choosing a three phase mixture from the phase diagram in a region opposite to the direction composition change as indicated by the arrow. If, for example, one chooses a three phase mixture of CaO, $Ba_3WO_6$, and $Ba_2CaWO_6$, volatilization of BaO and CaO will keep the composition three phase. This will occur so long as the composition is not at a phase boundary or close to a phase boundary, such as the phase boundary of $Ba_2CaWO_6$.

Figure 3:
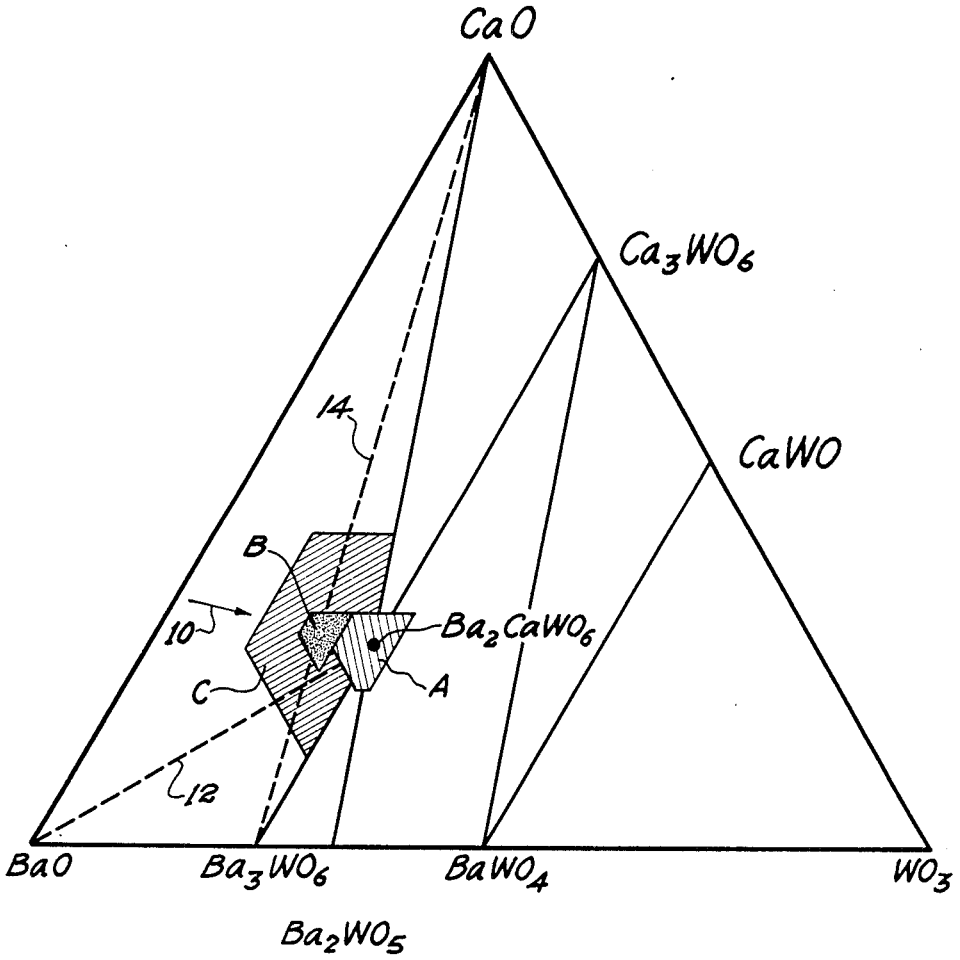
FIG. 3 is a triaxial graph of a ternary composition suitable for use in connection with the present invention.

The phase field which comprises phases BaO, CaO, $Ba_2CaWO_6$, and $Ba_3WO_6$ is not well established. The work reported in the literature, and indicated in above patent, shows a dashed line 12 between BaO and $BaCaWO_6$. However it appears to me that thermodynamically the line should be between CaO and $Ba_3WO_6$. Such a dashed line is illustrated in the figure as line 14. The emission mix claimed in this application is indicated in FIG. 3 as the areas enclosed within the shaped areas B and C, and preferably that enclosed within shaped area B. The compositions in these areas are mixtures of three phases derived from $Ba_2CaWO_6$, $Ba_3WO_6$, BaO and CaO. The proportions of the different constituents are different at various points of the areas within the shaped forms of the triaxial plot of compositions of FIG. 3.

It is recognized that due to higher CaO content there might be some loss of electron emission. The problem with the volatilization of BaO has also been recognized, as indicated above. However, a major advantage of the changes in emission composition is that the change will reduce the sodium loss. The problem of sodium loss was not associated with the composition of an emission mix heretofore.

The present invention also contemplates a reduction in the oxygen generated by introduction into the emission mix of powdered metal getters such as Zr, Hf, and Y in quantities small enough to avoid any decomposition of the mix.

The emission materials proposed in this invention can be made by a variety of techniques well known in the chemical or ceramic art. For emission materials containing only the oxides, any of the techniques in U.S. Pat. No. 3,708,710 would be suitable. However, for emission materials containing W or metal getter powder also, a modification is needed. In such a case, oxide mixtures can be obtained by a ball milling and firing technique discussed above. To this mixture, a suitable amount of finely divided metal powder of the desired composition can be blended.

What is claimed and sought to be protected by Letters Patent of the United States is as follows:

1. As an electron emission mix for a sodium vapor lamp the composition corresponding to points within the shaped areas B and C of the triaxial plot of FIG. 3 multiphase compositions derived from CaO, BaO and $WO_3$.

2. The emission mix of claim 1 in which the points are within shaped area B.

3. A thermionic electrode comprising a tungsten wire having deposited thereon a composition correponding to points within the shaped area B and C of the triaxial plot of FIG. 3 of compositions of CaO, BaO and $WO_3$.

4. The electrode of claim 3 in which the points are within shaped area B.

5. A high intensity electric discharge lamp comprising a light-transmission envelope having electrodes sealed into its ends and containing an ionizable medium for carrying the discharge, said electrodes consisting of a refractory metal support structure and an electron emissive component applied thereto consisting of a composition corresponding to points within the shaped areas B and C of the triaxial plot of FIG. 3 of multiphase compositions derived from CaO, BaO and $WO_3$.

6. A high intensity electric discharge lamp comprising a light-transmissive envelope having electrodes sealed into its ends and containing a ionizable medium for carrying the discharge, said electrodes consisting of a refractory metal support structure and an electron emissive compound applied thereto consisting of a composition corresponding to points within the shaped area B of the triaxial plot or FIG. 3 of multiphase compositions derived from CaO, BaO and $WO_3$.

* * * * *